US007294230B2

(12) United States Patent
Flugge-Berendes et al.

(10) Patent No.: US 7,294,230 B2
(45) Date of Patent: Nov. 13, 2007

(54) FLEXIBLE MULTI-PLY TISSUE PRODUCTS

(75) Inventors: Lisa Ann Flugge-Berendes, Appleton, WI (US); Thomas Gerard Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 443 days.

(21) Appl. No.: 11/017,463

(22) Filed: Dec. 20, 2004

(65) Prior Publication Data

US 2006/0130986 A1 Jun. 22, 2006

(51) Int. Cl.
*D21H 27/40* (2006.01)
*B32B 29/00* (2006.01)

(52) U.S. Cl. ..... 162/112; 162/109; 162/123; 162/132; 162/134; 428/154

(58) Field of Classification Search ..... 162/109–117, 162/125, 127, 132, 135–137, 123, 134; 156/183; 428/152–154; 264/283
See application file for complete search history.

(56) References Cited

U.S. PATENT DOCUMENTS

| | | | | |
|---|---|---|---|---|
| 3,772,124 | A | 11/1973 | Mayer | |
| 3,879,257 | A * | 4/1975 | Gentile et al. | 162/112 |
| 3,903,342 | A | 9/1975 | Roberts, Jr. | |
| 4,000,237 | A | 12/1976 | Roberts, Jr. | |
| 4,158,594 | A * | 6/1979 | Becker et al. | 162/112 |
| 4,304,625 | A * | 12/1981 | Grube et al. | 162/111 |
| 4,360,015 | A * | 11/1982 | Mayer | 602/47 |
| 4,429,014 | A * | 1/1984 | Isner et al. | 428/152 |
| 4,919,877 | A | 4/1990 | Parsons et al. | |
| 5,885,697 | A | 3/1999 | Krzysik et al. | |
| 6,423,180 | B1 * | 7/2002 | Behnke et al. | 162/112 |
| 6,610,173 | B1 * | 8/2003 | Lindsay et al. | 162/109 |
| 6,811,638 | B2 | 11/2004 | Close et al. | |
| 2003/0077314 | A1 | 4/2003 | Shannon et al. | |
| 2004/0099389 | A1 | 5/2004 | Chen et al. | |
| 2004/0120988 | A1 | 6/2004 | Masting | |
| 2004/0250969 | A1 | 12/2004 | Luu et al. | |
| 2005/0045294 | A1 | 3/2005 | Goulet et al. | |
| 2005/0045295 | A1 | 3/2005 | Goulet et al. | |
| 2005/0145352 | A1 | 7/2005 | Hermans et al. | |
| 2005/0148257 | A1 | 7/2005 | Hermans et al. | |
| 2005/0252626 | A1 | 11/2005 | Chen et al. | |
| 2006/0014884 | A1 | 1/2006 | Goulet et al. | |

FOREIGN PATENT DOCUMENTS

| | | |
|---|---|---|
| EP | 0 033 988 A2 | 8/1981 |
| WO | WO 97/47809 A1 | 12/1997 |
| WO | WO 98/55695 A1 | 12/1998 |

OTHER PUBLICATIONS

TAPPI Official Test Method T 411 om-89, "Thickness (Caliper) of Paper, Paperboard, and Combined Board," published by the TAPPI Press, Atlanta, Georgia, revised 1989, pp. 1-3.

* cited by examiner

*Primary Examiner*—Eric Hug
(74) *Attorney, Agent, or Firm*—Gregory E. Croft

(57) ABSTRACT

Lightweight multi-ply tissue products, such as facial tissue and bath tissue, are produced by printing flexible polymeric binder material, such as certain latex binders, onto one or more inner surfaces of the multi-ply tissue product. The resulting products have low stiffness and high strength.

18 Claims, 10 Drawing Sheets

FLEXIBLE MULTI-PLY TISSUE PRODUCTS

BACKGROUND OF THE INVENTION

Tissue products that are strong, soft and flexible are desired by consumers. One way of obtaining a soft tissue product is to increase the amount of debonder in the tissue to reduce the level of hydrogen bonding between fibers. While this increases the softness of the tissue, it also makes the tissue very weak. On the other hand, increasing the strength of the tissue by increasing the level of refining or increasing the amount of chemical strength agents will increase the level of hydrogen bonding between fibers and increase stiffness, which is also undesirable since increased stiffness generally reduces softness. One way to avoid this dilemma is to apply a polymeric binder having a low glass transition temperature, and therefore a flexible backbone, to the outside surfaces of the sheet. Hydrogen bonds, which impart strength to the tissue but make the tissue stiff, are replaced with the more flexible bonds of the polymeric binders. Bonding that occurs is due primarily to van der Waals' attractive forces between the polymer molecules and between cellulose fibers and the polymer molecules. In some cases, the binder may include small amounts of crosslinking components capable of forming covalent bonds between polymer molecules as well as between polymer molecules and fibers.

This approach has been used for heavyweight tissue products such as paper towels. For example, VIVA® Towels is a single-ply product that uses a topical application of a flexible strength agent in combination with creping often referred to as double recreping. The creped basesheet is heavily debonded, then printed on one side with a cross-linking polyethylenevinylacetate latex binder and recreped. The process is repeated for the other side of the sheet to form a very flexible and strong sheet with better softness than other sheets at equivalent strength. The resulting products have significantly preferred bulk softness over similar products made by more traditional methods such as conventional wet-pressing and throughdrying processes employing typical dry strengh and wet strength agents known in the art. While the bulk softness of such products is improved, the binder printed on the outside of the sheet provides a tacky feel that can be detrimental to products such as facial and bath tissue. For bath and facial tissue, surface softness is as important as bulk softness and the tacky feel of the binder can negatively affect the consumer's perception of surface softness.

Therefore, there is a need to improve the strength and bulk softness of lighter weight products such as facial tissue and bath tissue, without sacrificing surface softness.

SUMMARY OF THE INVENTION

It has been unexpectedly found that multi-ply tissue products, such as facial tissue and bath tissue, with improved strength and acceptable softness can be made through a modification to the afore-mentioned double recreping process. More specifically, one side of an uncreped through-dried tissue basesheet is printed with a flexible polymeric binder material and that side is thereafter placed against the surface of a creping cylinder, such as a Yankee dryer, and creped. (When a binder material is printed onto the surface of a sheet and the printed surface is thereafter creped, the resulting sheet is referred to herein as "print/creped"). The resultant tissue sheet is plied together with a like sheet such that the print/creped sides of the two plies are facing the interior of the resulting two-ply tissue product. This is contrary to conventional practice in which the creped side of a creped sheet, which is generally the softer of the two sides, is the outwardly-facing side of the sheet. However, it has been found that by positioning the print/creped sides of the treated sheets facing inwardly, an improved balance of strength and softness in the resulting product can be achieved. Furthermore, the lint and slough of the tissue products is not increased by having the latex treated side facing inward on the product.

Hence, in one aspect, the invention resides in a multi-ply tissue product comprising two outer plies and, optionally, one or more inner plies, each of the two outer plies having an inwardly-facing surface and an outwardly-facing surface, wherein the inwardly-facing surface of both outer plies has a print/creped application of a flexible polymeric binder material.

In another aspect, the invention resides in a method of making a multi-ply tissue product comprising: (a) providing a throughdried basesheet; (b) printing a flexible polymeric binder material onto one surface of the basesheet; (c) adhering the resulting printed surface of the basesheet to a creping cylinder and creping the basesheet, whereby the resulting basesheet has a print/creped surface and a non-print/creped surface; and (d) converting the resulting basesheet into a multi-ply tissue product having two outer plies, such that the print/creped surface of each outer ply is facing inwardly.

The Stiffness Factor (hereinafter defined) of the products of this invention can be about 3.0 or less, more specifically about 2.0 or less, more specifically from about 1.5 to about 2.5, more specifically from about 1.7 to about 2.3 and still more specifically from about 1.8 to about 2.2.

The basis weight of the multi-ply products of this invention can be any weight suitable for facial or bath tissue. These basis weights are typically lower than those useful for paper towels. More specifically, the basis weight of the multi-ply products of this invention can be from about 15 to about 55 grams per square meter (gsm), more specifically from about 20 to about 50 gsm and still more specifically from about 25 gsm to about 50 gsm.

The geometric mean tensile strength of the multi-ply products of the present invention can be from about 700 to about 2500 grams (force) per 3 inches of sample width (sometimes simply referred to herein as "grams" for convenience), more specifically from about 800 to about 2200 grams, and still more specifically from about 1000 to about 2000 grams.

The caliper of the multi-ply products of the present invention can be from about 250 to about 500 microns, more specifically from about 275 to about 475 microns, and still more specifically from about 325 to about 450 microns.

The bulk of the multi-ply products of the present invention can be from about 6 to about 12 cubic centimeters per gram (cc/g), more specifically from about 6.5 to about 11 cc/g, and still more specifically from about 7 to about 10 cc/g.

A wide variety of natural and synthetic pulp fibers are suitable for use in the multi-ply tissue products of this invention. The pulp fibers may include fibers formed by a variety of pulping processes, such as kraft pulp, sulfite pulp, thermomechanical pulp, etc. In addition, the pulp fibers may consist of any high-average fiber length pulp, low-average fiber length pulp, or mixtures of the same. One example of suitable high-average length pulp fibers includes softwood fibers. Softwood pulp fibers are derived from coniferous trees and include pulp fibers such as, but not limited to, northern softwood, southern softwood, redwood, red cedar, hemlock, pine (e.g., southern pines), spruce (e.g., black spruce), combinations thereof, and the like. Northern softwood kraft pulp fibers may be used in the present invention. One example of commercially available northern softwood kraft pulp fibers suitable for use in the present invention include those available from Kimberly-Clark Corporation located in Neenah, Wis. under the trade designation of "Longlac-19". An example of suitable low-average length pulp fibers are the so called hardwood pulp fibers. Hardwood pulp fibers are derived from deciduous trees and include pulp fibers such as, but not limited to, eucalyptus, maple, birch, aspen, and the like. In certain instances, eucalyptus pulp fibers may be particularly desired to increase the softness of the tissue sheet. Eucalyptus pulp fibers may also enhance the brightness, increase the opacity, and change the pore structure of the tissue sheet to increase its wicking ability. Moreover, if desired, secondary pulp fibers obtained from recycled materials may be used, such as fiber pulp from sources such as, for example, newsprint, reclaimed paperboard, and office waste.

In one embodiment of the invention, one or more of the tissue sheets of the multi-ply tissue products of the present invention is a blended sheet wherein the hardwood pulp fibers and softwood pulp fibers are blended prior to forming the tissue sheet thereby producing a homogenous distribution of hardwood pulp fibers and softwood pulp fibers in the z-direction of the tissue sheet. In another embodiment of the invention, one or more of the tissue sheets of the multi-ply tissue products of the present invention is layered, wherein the hardwood pulp fibers and softwood pulp fibers are layered so as to give a heterogeneous distribution of hardwood pulp fibers and softwood pulp fibers in the z-direction of the tissue sheet. In another embodiment, the hardwood pulp fibers are located in at least one of the outer layers of the tissue product and/or tissue sheets wherein at least one of the inner layers may comprise softwood pulp fibers. In another specific embodiment of the invention, the tissue sheets comprising the flexible polymeric binder material comprise a layered tissue sheet, wherein one of the outer layers of the layered tissue sheet comprises softwood fibers and the other outer layer of the layered tissue sheet comprises hardwood fibers, wherein the flexible polymeric binder material is applied to the outer layer of the layered tissue sheet comprising the softwood fibers.

The softness or flexibility of the flexible polymeric binder material can be inferred from its glass transition temperature. The glass transition temperature of the flexible polymeric binder materials particularly suitable for purposes of this invention is about 50° C. or less, more specifically about 40° C. or less, more specifically about 20° C. or less, more specifically from about −40° C. to about 40° C., and still more specifically from about −15° C. to about 20° C. Ideally the glass transition temperature of the flexible polymeric binder is chosen such that it is low enough to provide the desired flexibility to the sheet yet high enough to minimize tackiness at ambient temperature and humidity. A particularly suitable class of flexible polymeric binder materials useful for providing the bonding in one or both of the two outer layers is polymeric binders derived from ethylene vinylacetate copolymers and derivatives thereof. The ethylene vinylacetate copolymers can be delivered in any form, particularly including latex emulsions. Particular examples of latex flexible polymeric binder materials that can be used for purposes of this invention include Airflex® 426, Airflex® 410 and Airflex® EN 1165 sold by Air Products Inc. or ELITE® PE BINDER available from National Starch. It is believed that all of the foregoing flexible polymeric binder materials are ethylene/vinylacetate copolymers. Other suitable flexible polymeric binder materials include, without limitation, polyvinyl chloride, styrene-butadiene, polyurethanes, modified versions of the foregoing materials, and the like. Suitable means for applying the flexible polymeric binder material include spraying and printing.

The flexible polymeric binder materials can optionally be crosslinkable. They may be capable of forming covalent crosslinks with themselves, with cellulose, or with both themselves and cellulose. Without limitation, suitable crosslinking groups include n-methylol acrylamide, epoxy, aldehyde, anhydride and the like. A specific crosslinking flexible polymeric binder material suitable for purposes of this invention is Airflex® EN1165 sold by Air Products. This binder is believed to be an ethylene/vinylacetate copolymer containing n-methylol acrylamide groups capable of forming covalent bonds with both cellulose and itself.

The amount of flexible polymeric binder material in the products of this invention may vary widely and will depend at least in part on the particular properties desired. The amount of flexible polymeric binder material in any ply containing the flexible polymeric binder material will generally range from about 1 to about 12 percent by weight of dry fibers in that ply, more specifically from about 2 to about 10 weight percent and more specifically from about 3 to about 9 weight percent. For multi-ply products of this invention having three or more plies, the amount of flexible polymeric binder material in the middle ply or plies can be less than the amount of flexible polymeric binder material in the two outer plies. In a particular embodiment of a three-ply product, the inner ply can have no binder material.

The surface area coverage of the printed pattern which provides the flexible polymeric binder material can be from about 20 to about 95 percent, more specifically from about 30 to about 85 percent and still more specifically from about 40 to about 80 percent.

Optional chemical additives may also be added to the aqueous papermaking furnish or to one or more tissue sheets of the multi-ply tissue products of the present invention to impart additional benefits to the product and process. Such chemicals may be added at any point in the papermaking process, such as before or after addition of the flexible polymeric binder material.

For example, debonding agents may be applied to the fibers in any or all plies of the sheet. Debonding agents useful for reducing the strength in the sheet(s) include any chemical that diminishes the capability of papermaking fibers to hydrogen bond together, thereby reducing the stiffness of the resulting sheet and increasing perceived softness. Any known in the art debonder can be used to reduce the strength of the sheet. Examples of such chemical debonders include quaternary ammonium compounds, mixtures of quaternary ammonium compounds with polyhydroxy compounds. Examples of quaternary ammonium compounds suitable for use in the present invention include dialkyldimethylammonium salts such as ditallow dimethyl ammonium chloride, ditallow dimethylammonium methyl sulfate, and di(hydrogenated)tallow dimethyl ammonium chloride. Particularly suitable debonding agents are 1-methyl-2 noroleyl-3 oleyl amidoethyl imidazolinium methyl sulfate and 1-ethyl-2 noroleyl-3 oleyl amidoethyl imidazolinium ethylsulfate. Suitable commercial chemical debonding agents include, without limitation, Witco Varisoft 6027 and Hercules Prosoft TQ 1003. The debonding agent(s) can be applied anywhere in the process but is preferably applied to the fibers prior to forming the sheet.

Charge promoters and control agents, which are commonly used in the papermaking process to control the zeta potential of the papermaking furnish in the wet end of the process, can also be used. These species may be anionic or cationic, most usually cationic, and may be either naturally occurring materials such as alum or low molecular weight high charge density synthetic polymers typically of molecular weight of about 500,000 or less. Drainage and retention aids may also be added to the furnish to improve formation, drainage and fines retention. Included within the retention and drainage aids are microparticle systems containing high surface area, high anionic charge density materials.

Wet and dry strength agents may also be applied to the tissue sheet. As used herein, "wet strength agents" refer to materials used to immobilize the bonds between fibers in the wet state. Any material that when added to a tissue sheet or sheet results in providing the tissue sheet with a mean wet geometric tensile strength:dry geometric tensile strength ratio in excess of about 0.1 is, for purposes of the present invention, termed a wet strength agent. Typically these materials are referred to as permanent wet strength agents or as "temporary" wet strength agents. For the purposes of differentiating permanent wet strength agents from temporary wet strength agents, the permanent wet strength agents will be defined as those resins which, when incorporated into paper or tissue products, will provide a paper or tissue product that retains more than 50 percent of its original wet strength after exposure to water for a period of at least five minutes. Temporary wet strength agents are those which show about 50 percent or less of their original wet strength after being saturated with water for five minutes. Both classes of wet strength agents may find application for the tissue products of the present invention. If present, the amount of wet strength agent added to the pulp fibers can be about 0.1 dry weight percent or greater, more specifically about 0.2 dry weight percent or greater, and still more specifically from about 0.1 to about 3 dry weight percent, based on the dry weight of the fibers.

The temporary wet strength agents may be cationic, nonionic or anionic. Such compounds include, without limitation, PAREZ™ 631 NC and PAREZ® 725 temporary wet strength resins that are cationic glyoxylated polyacrylamide available from Cytec Industries (West Paterson, N.J.). Hercobond 1366, manufactured by Hercules, Inc., located at Wilmington, Del., is another commercially available cationic glyoxylated polyacrylamide that may be used in accordance with the present invention. Additional examples of temporary wet strength agents include dialdehyde starches such as Cobond® 1000 from National Starch and Chemical Company and other aldehyde containing polymers known in the art.

Suitable permanent wet strength agents include cationic oligomeric or polymeric resins. Polyamide-polyamine-epichlorohydrin type resins, such as KYMENE 557H sold by Hercules, Inc., located at Wilmington, Del., are the most widely used permanent wet-strength agents. Other cationic resins include polyethylenimine resins and aminoplast resins obtained by reaction of formaldehyde with melamine or urea. It is often advantageous to use both permanent and temporary wet strength resins in the manufacture of tissue products of this invention.

Suitable dry strength agents include, but are not limited to, modified starches and other polysaccharides such as cationic, amphoteric, and anionic starches and guar and locust bean gums, modified polyacrylamides, carboxymethylcellulose, sugars, polyvinyl alcohol, chitosans, and the like. Such dry strength agents are typically added to a fiber slurry prior to tissue sheet formation or as part of the creping package. While such dry strength agents may be added to the sheets, such dry strength agents increase the strength of the sheet by increasing the amount of hydrogen bonding in the sheet and hence increasing the stiffness of the sheet. Due to the strength developed by the flexible polymeric binder, such dry strength agents are not usually required in the tissue sheets that comprise the polymeric flexible binder material.

Other optional materials include cationic dyes, optical brighteners, absorbency aids and the like. In some applications, the tissue products of this invention may be treated with lotions and/or various other additives for numerous desired benefits. For example, formulations containing polysiloxanes may be topically applied to the tissue products in order to further increase the surface softness of the product. A variety of substituted and non-substituted polysiloxanes can be used.

Lotions can also be applied to the tissue products of this invention. Suitable lotions can be water-based or oil-based. Suitable water-based compositions include, but are not limited to, emulsions and water-dispersible compositions which can contain, for example, debonders (cationic, anionic or nonionic surfactants), or polyhydroxy compounds such as glycerin or propylene glycol. Oil-based lotions can contain, for instance, a mixture of an oil and a wax. For example, the composition may contain from about 30 to about 90 percent by weight oil and from about 10 to about 40 percent by weight wax. In some embodiments, a fatty alcohol may also be included in an amount from about 5 to about 40 percent by weight. Suitable oils include, but are not limited to, the following classes of oils: petroleum or mineral oils, such as mineral oil and petrolatum; animal oils, such as mink oil and lanolin oil; plant oils, such as aloe extract, sunflower oil and avocado oil; and silicone oils, silicone fluids, silicone emulsions or mixtures thereof. For example, dimethicone and alkyl methyl silicones can be used. Suitable waxes include, but are not limited to, the following classes: natural waxes, such as beeswax and carnauba wax; petroleum waxes, such as paraffin and ceresin wax; silicone waxes, such as alkyl methyl siloxanes; or synthetic waxes, such as synthetic beeswax and synthetic sperm wax or mixtures thereof. Suitable fatty alcohols include alcohols having a carbon chain length of from about 14 to about 30 carbon atoms, including acetyl alcohol, stearyl alcohol, behenyl alcohol, and dodecyl alcohol.

The number of plies of the products of this invention can be two, three, four, five or more. The various plies can be the same or different. For example, if a three-ply tissue is being made, the two outer plies can have an inwardly-facing print/creped surface and the center ply can be the same or can have no print/creped surfaces or can have both surfaces print/creped.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of 1-5 shall be considered to support claims to any of the following sub-ranges: 1-4; 1-3; 1-2; 2-5; 2-4; 2-3; 3-5; 3-4; and 4-5.

DETAILED DESCRIPTION OF THE DRAWINGS

Figure 1:
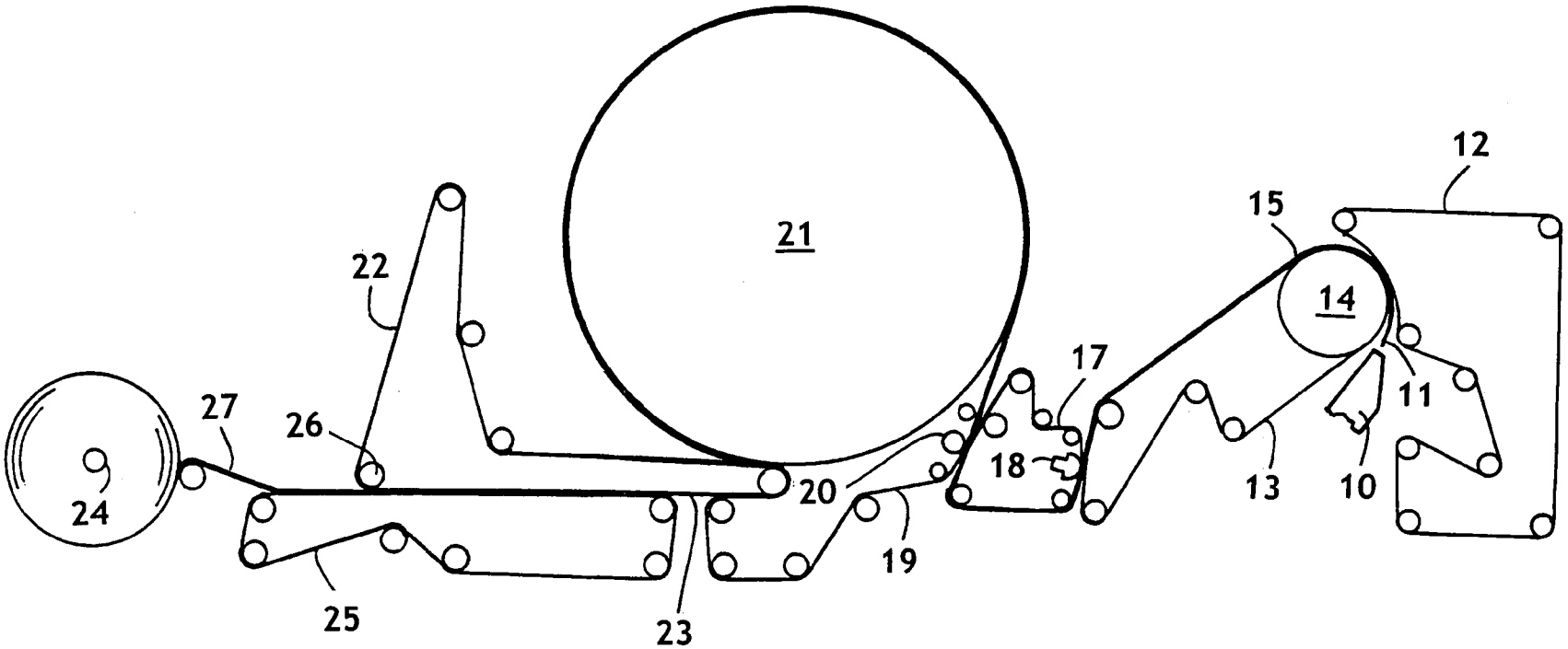
FIG. 1 is a schematic illustration of an uncreped through-dried tissue making process suitable for purposes of making basesheet plies in accordance with this invention.

FIG. 1 is a schematic illustration of an uncreped through-dried process useful for making basesheets suitable for purposes of this invention. Shown is a twin wire former 8 having a papermaking headbox 10 which injects or deposits a stream 11 of an aqueous suspension of papermaking fibers onto a plurality of forming fabrics, such as the outer forming fabric 12 and the inner forming fabric 13, thereby forming a wet tissue web 15. The forming process of the present invention may be any conventional forming process known in the papermaking industry. Such formation processes include, but are not limited to, Fourdrinier formers, roof formers such as suction breast roll formers, and gap formers such as twin wire formers and crescent formers.

The wet tissue web 15 forms on the inner forming fabric 13 as the inner forming fabric 13 revolves about a forming roll 14. The inner forming fabric 13 serves to support and carry the newly-formed wet tissue web 15 downstream in the process as the wet tissue web 15 is partially dewatered to a consistency of about 10 percent based on the dry weight of the fibers. Additional dewatering of the wet tissue web 15 may be carried out by known paper making techniques, such as vacuum suction boxes, while the inner forming fabric 13 supports the wet tissue web 15. The wet tissue web 15 may be additionally dewatered to a consistency of at least about 20 percent, more specifically between about 20 to about 40 percent, and more specifically about 20 to about 30 percent. The wet tissue web 15 is then transferred from the inner forming fabric 13 to a transfer fabric 17 traveling preferably at a slower speed than the inner forming fabric 13 in order to impart increased MD stretch into the wet tissue web 15. The rush transfer is maintained at an appropriate level to ensure the right combination of stretch and strength in the finished product. Depending on the fabrics utilized and the post-tissue-machine converting process, the rush transfer should be in the range of from about 10 to about 25 percent.

The wet tissue web 15 is then transferred from the transfer fabric 17 to a throughdrying fabric 19 whereby the wet tissue web 15 may be macroscopically rearranged to conform to the surface of the throughdrying fabric 19 with the aid of a vacuum transfer roll 20 or a vacuum transfer shoe like the vacuum shoe 18. If desired, the throughdrying fabric 19 can be run at a speed slower than the speed of the transfer fabric 17 to further enhance MD stretch of the resulting absorbent sheet. The transfer may be carried out with vacuum assistance to ensure conformation of the wet tissue web 15 to the topography of the throughdrying fabric 19.

While supported by the throughdrying fabric 19, the wet tissue web 15 is dried to a final consistency of about 94 percent or greater by a throughdryer 21 and is thereafter transferred to a carrier fabric 22. Alternatively, the drying process can be any non-compressive drying method that tends to preserve the bulk of the wet tissue web 15.

The dried tissue web 23 is transported to a reel 24 using a carrier fabric 22 and an optional carrier fabric 25. An optional pressurized turning roll 26 can be used to facilitate transfer of the dried tissue web 23 from the carrier fabric 22 to the carrier fabric 25. If desired, the dried tissue web 23 may additionally be embossed to produce a pattern on the absorbent tissue product produced using the throughdrying fabric 19 and a subsequent embossing stage.

Once the wet tissue web 15 has been non-compressively dried, thereby forming the dried tissue web 23, it is possible to crepe the dried tissue web 23 by transferring the dried tissue web 23 to a Yankee dryer prior to reeling, or using alternative foreshortening methods such as micro-creping as disclosed in U.S. Pat. No.4,919,877 issued on Apr. 24, 1990 to Parsons et al., herein incorporated by reference.

In an alternative embodiment not shown, the wet tissue web 15 may be transferred directly from the inner forming fabric 13 to the throughdrying fabric 19, thereby eliminating the transfer fabric 17. The throughdrying fabric 19 may be traveling at a speed less than the inner forming fabric 13 such that the wet tissue web 15 is rush transferred or, in the alternative, the throughdrying fabric 19 may be traveling at substantially the same speed as the inner forming fabric 13.

Figure 2A:
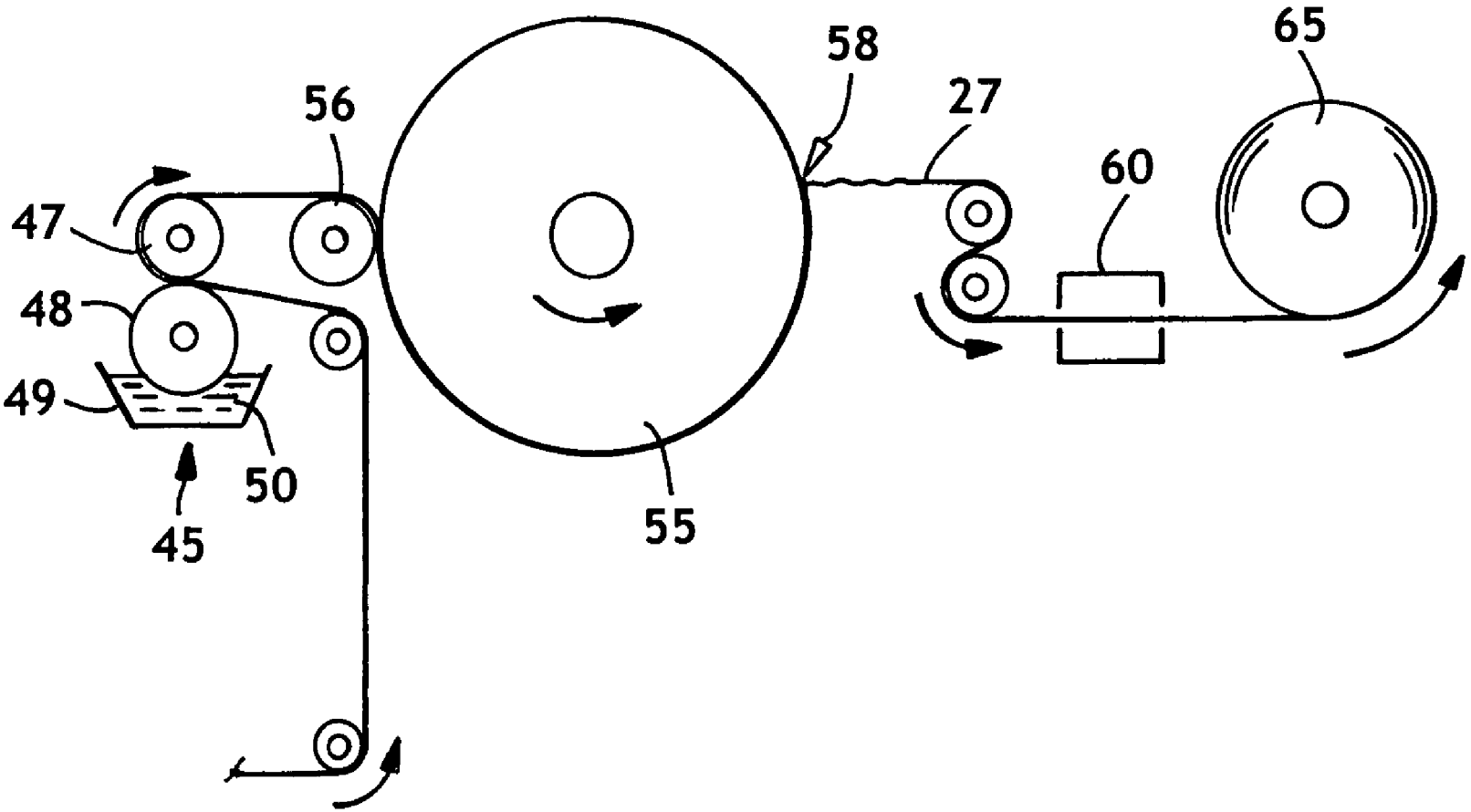
FIG. 2A is a schematic illustration of a print-crepe method of applying flexible polymeric binder material to the basesheet made by the process of FIG. 1 in accordance with this invention.

FIG. 2A is a schematic representation of a print/crepe process in which a flexible polymeric binder material is applied to one outer surface of the throughdried basesheet as produced in accordance with FIG. 1. Although gravure printing of the binder is illustrated, other means of applying the flexible polymeric binder material can also be used, such as foam application, spray application, flexographic printing, or digital printing methods such as ink jet printing and the like. Shown is paper sheet 27 passing through a flexible polymeric binder material application station 45. Station 45 includes a transfer roll 47 in contact with a rotogravure roll 48, which is in communication with a reservoir 49 containing a suitable binder 50. The flexible polymeric binder material 50 is applied to one side of the sheet in a preselected pattern. After the flexible polymeric binder material is applied, the sheet is adhered to a creping roll 55 by a press roll 56. The sheet is carried on the surface of the creping roll for a distance and then removed therefrom by the action of a creping blade 58. The creping blade performs a controlled pattern creping operation on the side of the sheet to which the flexible polymeric binder material was applied.

Once creped, the sheet 27 is pulled through an optional drying station 60. The drying station can include any form of a heating unit, such as an oven energized by infrared heat, microwave energy, hot air or the like. Alternatively, the drying station may comprise other drying methods such as photo-curing, UV-curing, corona discharge treatment, electron beam curing, curing with reactive gas, curing with heated air such as through-air heating or impingement jet heating, infrared heating, contact heating, inductive heating, microwave or RF heating, and the like. The drying station may be necessary in some applications to dry the sheet and/or cure the flexible polymeric binder material materials. Depending upon the flexible polymeric binder material selected, however, drying station 60 may not be needed. Once passed through the drying station, the sheet can be wound into a roll of material or product 65.

Figure 2B:
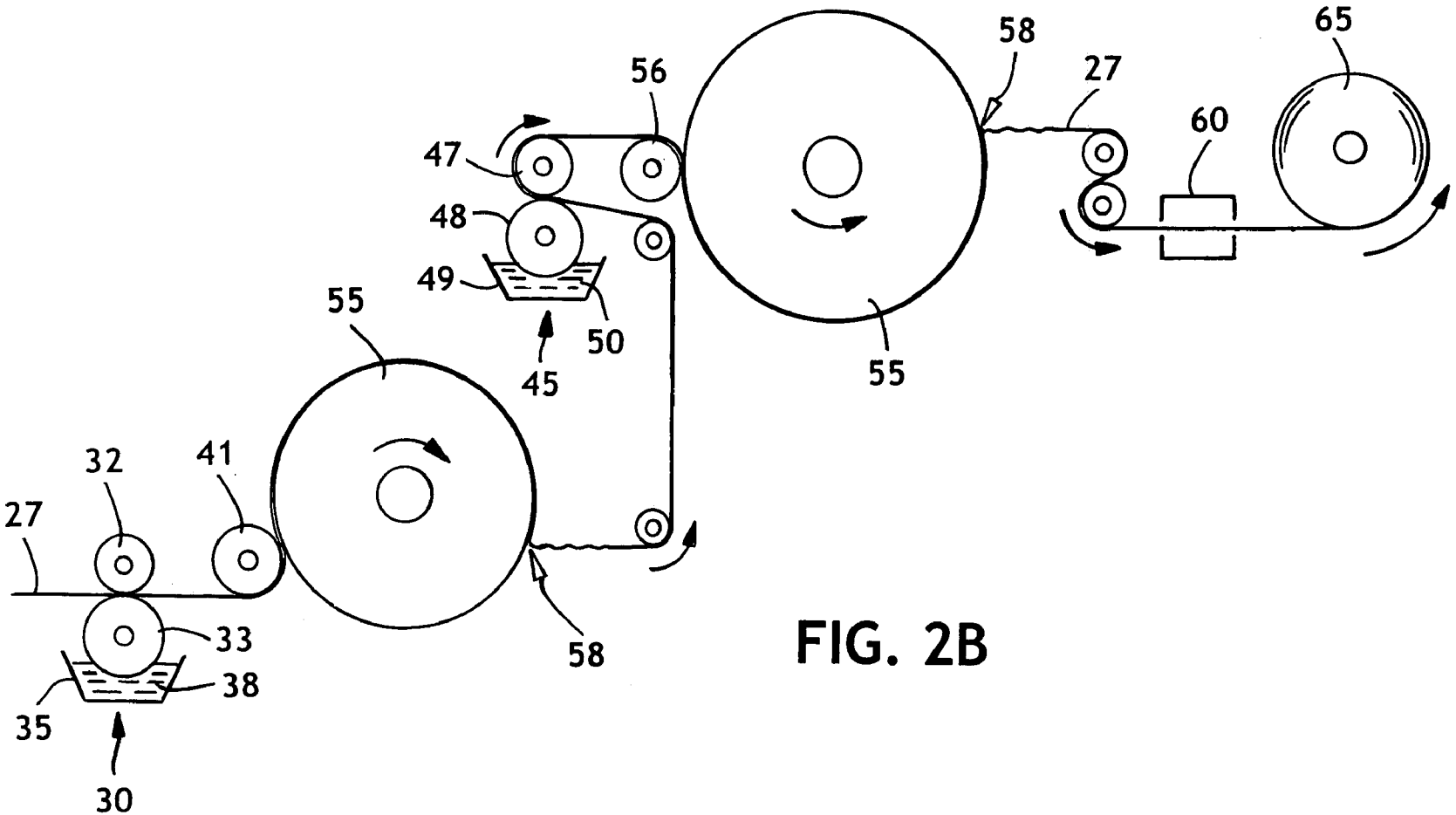
FIG. 2B is a schematic illustration of a print-crepe-print-crepe method of applying flexible polymeric binder material to the basesheet made in accordance with the process of FIG. 1, which can be used for the center ply of a three-ply product in accordance with this invention.

FIG. 2B is similar to FIG. 2A, except that both sides of the sheet are printed and creped. More specifically, shown is paper sheet 27 passing through a first flexible polymeric binder material application station 30. Station 30 includes a nip formed by a smooth rubber press roll 32 and a patterned rotogravure roll 33. Rotogravure roll 33 is in communication with a reservoir 35 containing a first flexible polymeric binder material 38. Rotogravure roll 33 applies the flexible polymeric binder material 38 to one side of sheet 27 in a pre-selected pattern. Thereafter the printed sheet is applied to a creping drum 55 and dislodged from the surface with creping blade 58. The print/creped sheet is then passed to a second print/crepe station and processed as illustrated in FIG. 2A.

Figure 3:
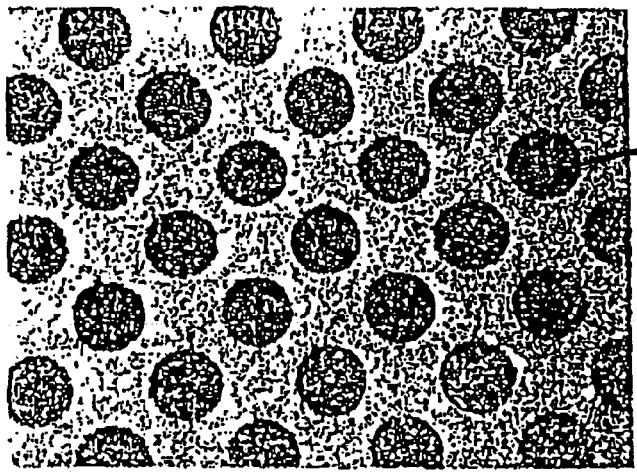
FIG. 3 is a representation of a flexible polymeric binder material pattern (dot pattern) which can be applied to the basesheet.

FIG. 3 shows one embodiment of a print pattern that can be used for applying a flexible polymeric binder material to a paper sheet in accordance with this invention. As illustrated, the pattern represents a succession of discrete dots 70. In one embodiment, for instance, the dots can be spaced so that there are approximately from about 25 to about 35 dots per inch (25.4 mm) in the machine direction and/or the cross-machine direction. The dots can have a diameter, for example, of from about 0.01 inch (0.25 mm) to about 0.03 inch (0.76 mm). In one particular embodiment, the dots can have a diameter of about 0.02 inch (0.51 mm) and can be present in the pattern so that approximately 28 dots per inch (25.4 mm) extend in either the machine direction or the cross-machine direction. Besides dots, various other discrete shapes such as elongated ovals or rectangles can also be used when printing the flexible polymeric binder material onto the sheet.

Figure 4:
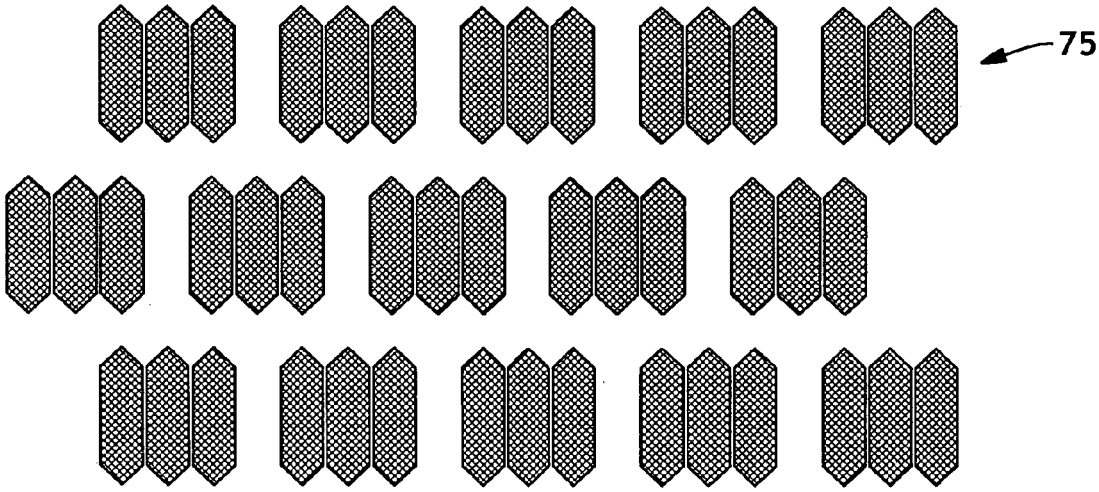
FIG. 4 is a representation of an alternative flexible polymeric binder material pattern (hexagonal element pattern) which can be applied to the basesheet.

FIG. 4 shows a flexible polymeric binder material print pattern made up of multiple elements 75 that are each comprised of three elongated hexagonal cells. Each element corresponds to a distinct deposit on the sheet. In one embodiment, each hexagonal cell can be about 0.02 inch (0.51 mm) long (machine direction dimension) and can have a width of about 0.006 inch (0.15 mm). Approximately 35 to 40 elements per inch (25.4 mm) can be spaced in the machine direction and the cross-machine direction.

Figure 5:
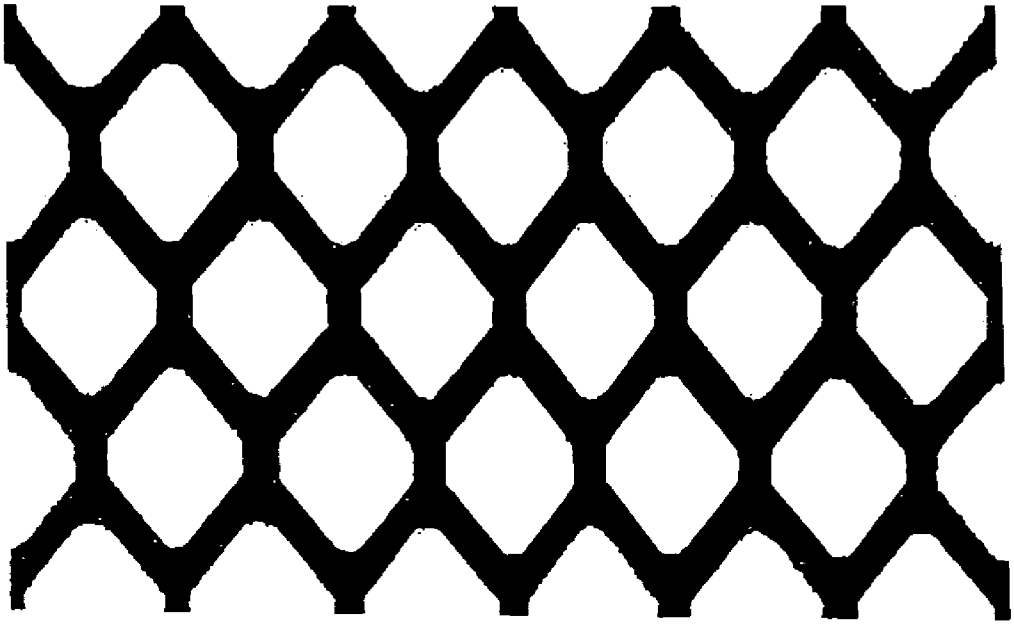
FIG. 5 is a representation of an alternative flexible polymeric binder material pattern (reticulated pattern) that can be applied to the basesheet.

FIG. 5 illustrates an alternative flexible polymeric binder material pattern in which the flexible polymeric binder material is printed onto the sheet in a reticulated pattern. The dimensions are similar to those of the dot pattern of FIG. 3. Reticulated patterns, which provide a continuous network of flexible polymeric binder material, may result in relatively greater sheet strength than comparable patterns of discrete elements, such as the dot pattern of FIG. 3.

Figure 6:
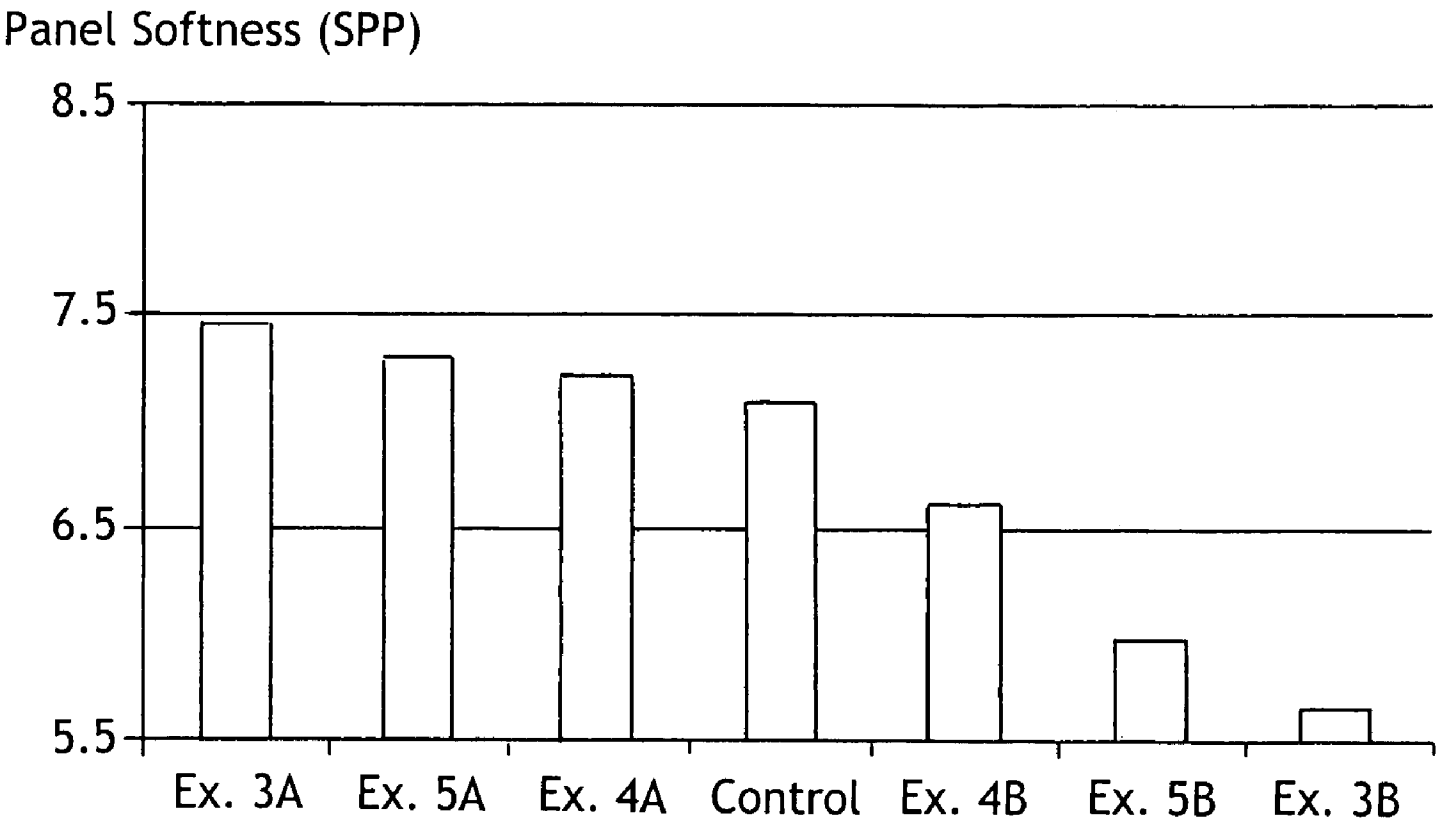
FIG. 6 is a bar graph illustrating the panel softness of the tissue products of the Examples.
Figure 7:
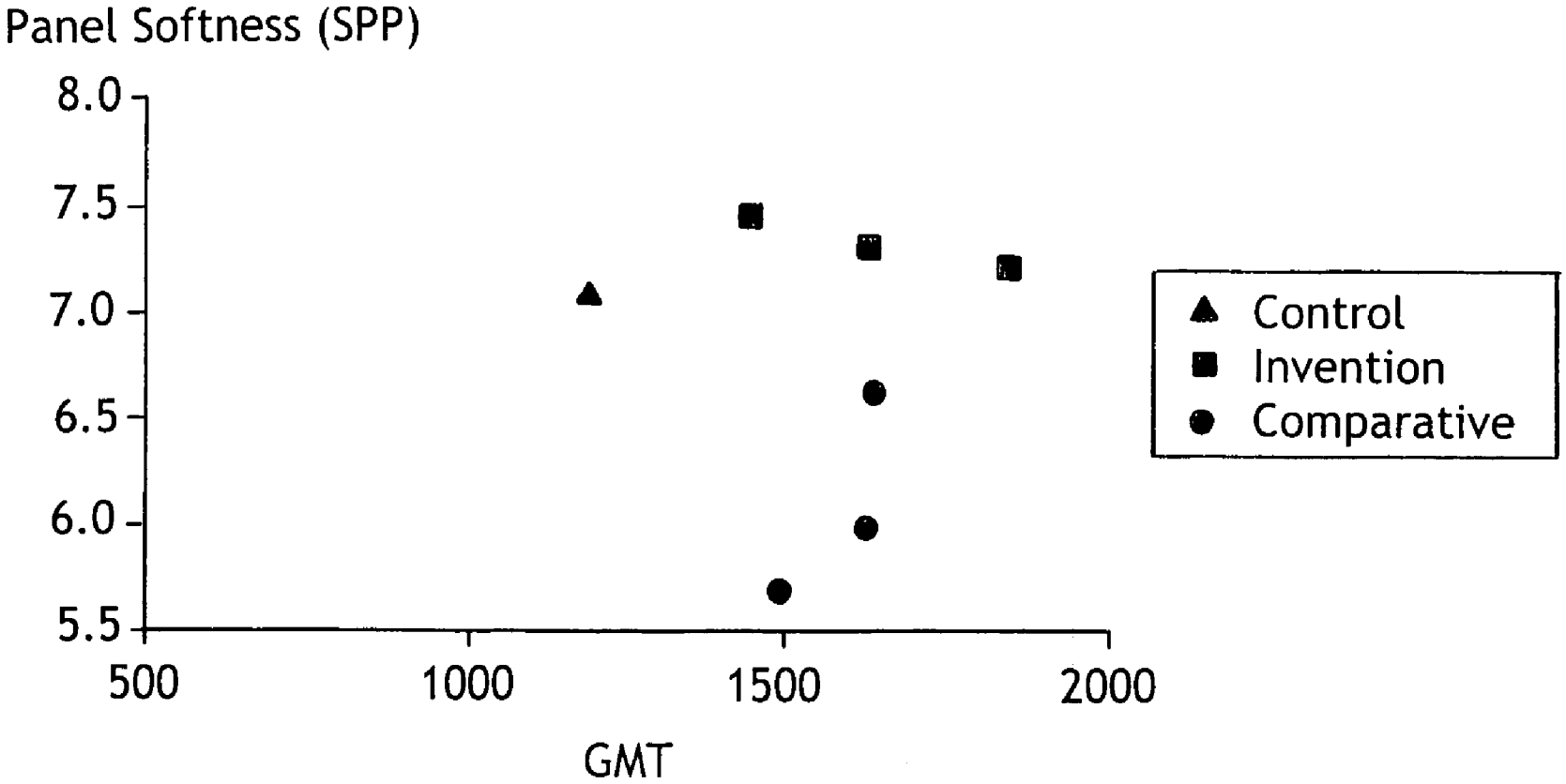
FIG. 7 is a plot of the panel softness versus the geometric mean tensile strength for the tissue products of the Examples.

FIGS. 6 and 7 are discussed in connection with the description of the Examples below.

Figure 8:
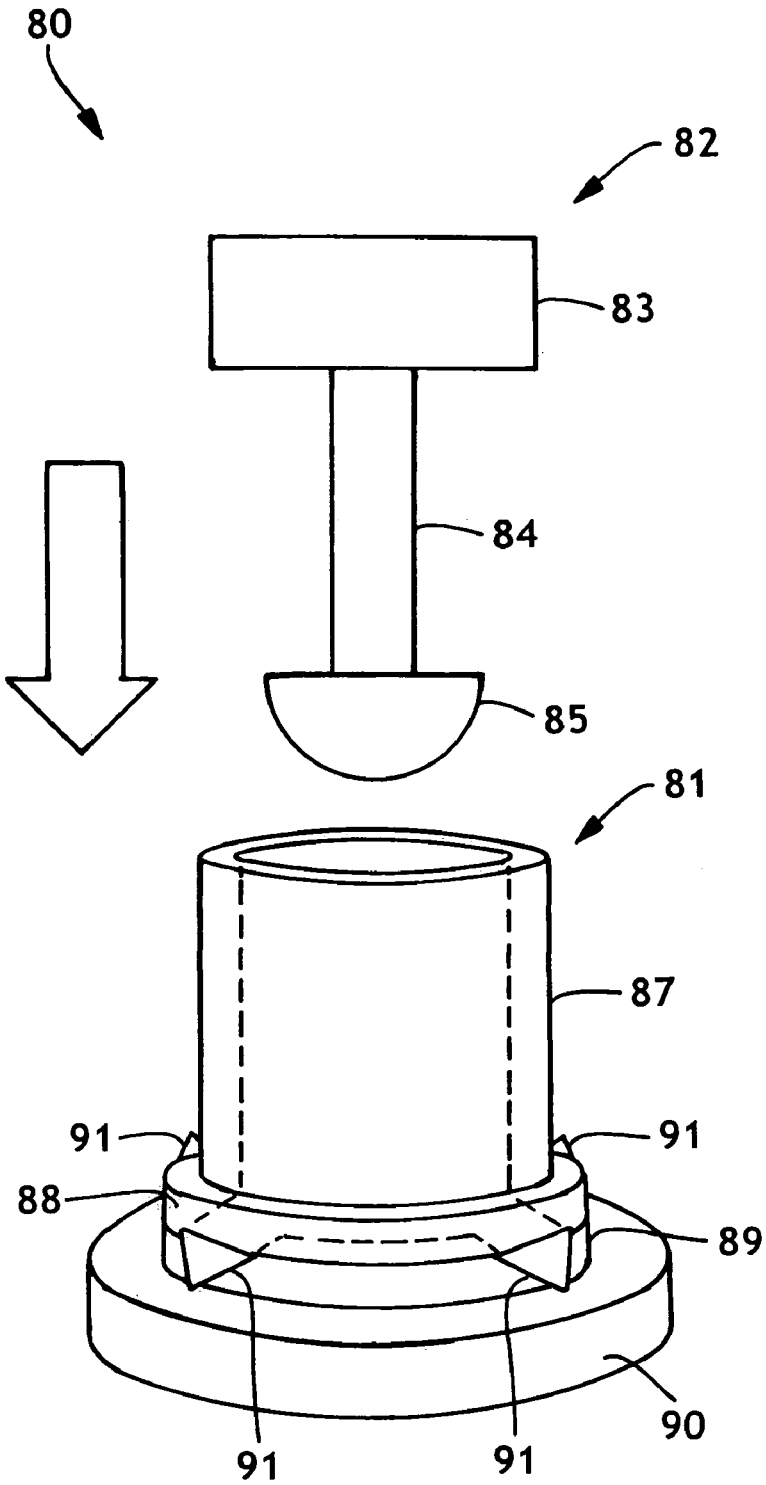
FIG. 8 is a schematic representation of the apparatus for carrying out the cup crush test.
Figure 9:
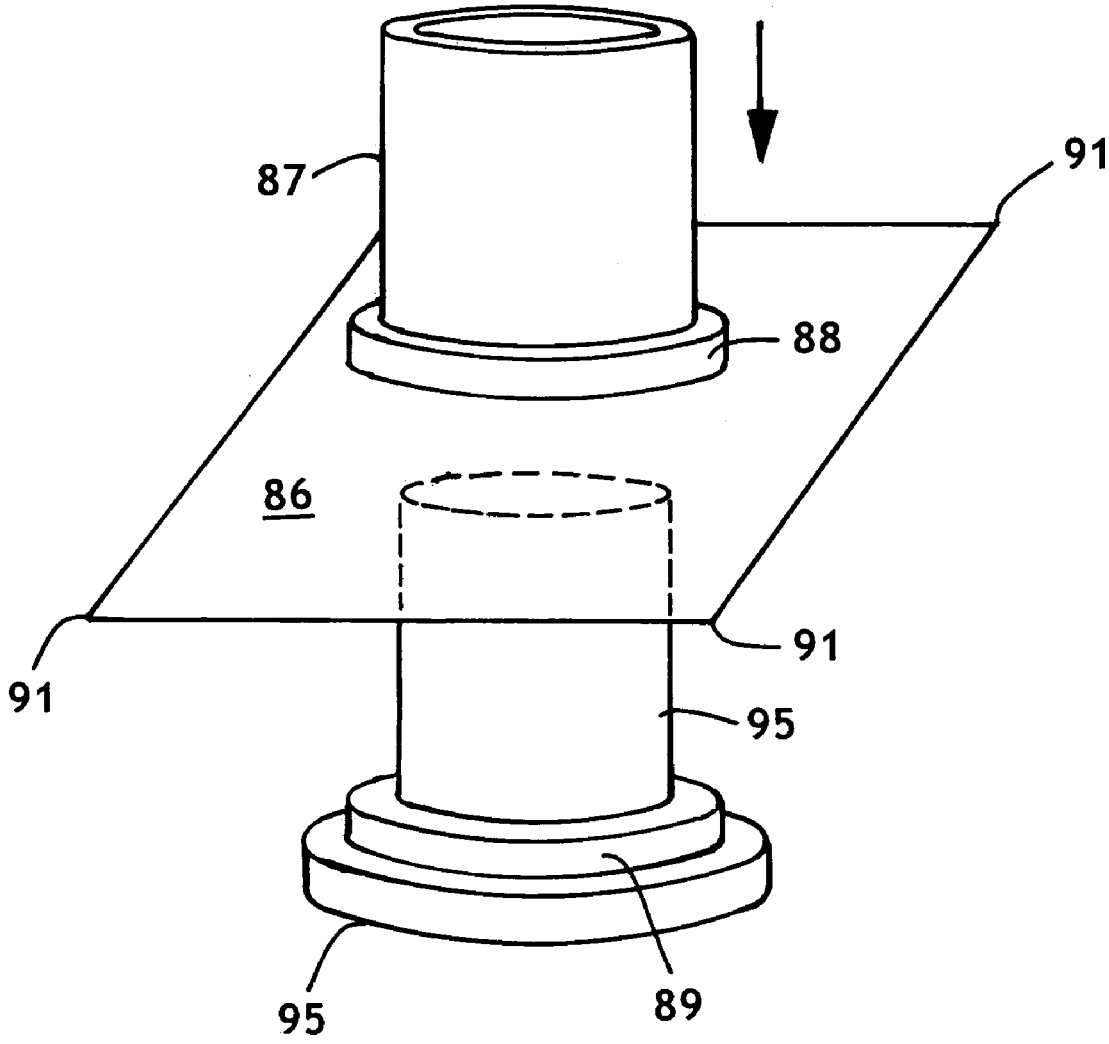
FIG. 9 is a schematic representation of the apparatus used in preparing a sample sheet for the cup crush test.
Figure 10:
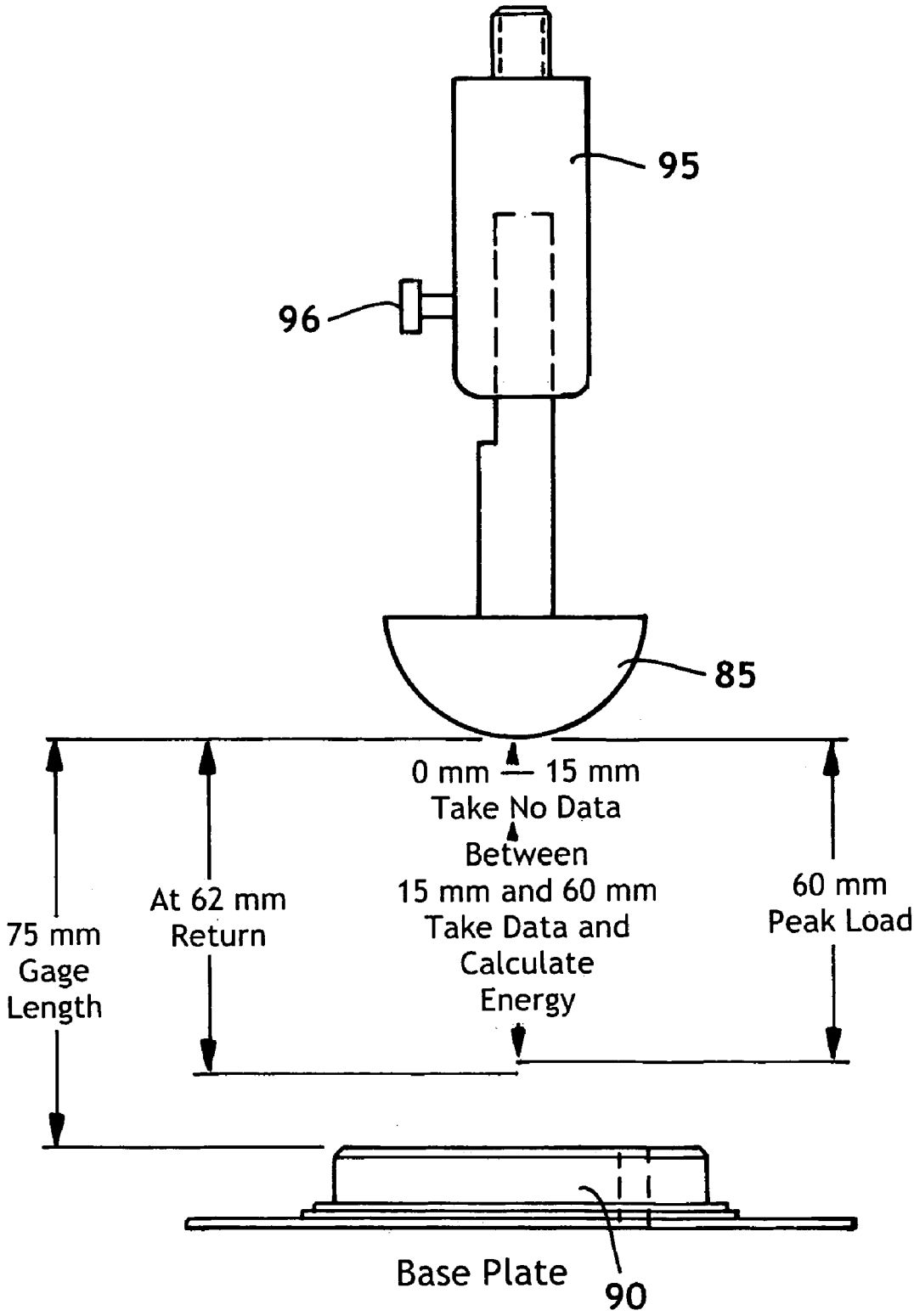
FIG. 10 is a further schematic representation of the cup crush apparatus.

FIGS. 8-10 are discussed in connection with the description of the cup crush test described below.

Test Methods

As used herein, the "machine direction tensile strength" (MD tensile strength) is the peak load per 3 inches of sample width when a sample is pulled to rupture in the machine direction. Similarly, the "cross-machine direction tensile strength" (CD tensile strength) is the peak load per 3 inches of sample width when a sample is pulled to rupture in the cross-machine direction. The "geometric mean tensile strength" (GMT) is the square root of the product of the MD tensile strength multiplied by the CD tensile strength. All of the tensile strength parameters can be measured wet or dry. "Stretch" is the percent elongation of the sample at the point of rupture.

Samples for dry tensile strength testing are prepared by cutting a 3 inches (76.2 mm) wide by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10-90% of the load cell's full scale value. The gauge length between jaws is 4±0.04 inches (101.6±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65%. The sample is placed in the jaws of the instrument, centered both vertically and horizontally. The test is then started and ends when the specimen breaks. The peak load is recorded as either the "MD tensile strength" or the "CD tensile strength" of the specimen depending on direction of the sample being tested. At least six (6) representative specimens are tested for each product or sheet and the arithmetic average of all individual specimen tests is either the MD or CD tensile strength for the product or sheet.

Wet tensile strength measurements are measured in the same manner, but are only typically measured in the cross-machine direction of the sample. Prior to testing, the center portion of the CD sample strip is saturated with tap water immediately prior to loading the specimen into the tensile test equipment. CD wet tensile measurements can be made immediately after the product is made. Sample wetting is performed by first laying a single test strip onto a piece of blotter paper (Fiber Mark, Reliance Basis 120). A pad is then used to wet the sample strip prior to testing. The pad is a Scotch-Brite® brand (3M) general purpose commercial scrubbing pad. To prepare the pad for testing, a full-size pad is cut approximately 2.5 inches (63.5 mm) long by 4 inches (101.6 mm) wide. A piece of masking tape is wrapped around one of the 4 inch (101.6 mm) long edges. The taped side then becomes the "top" edge of the wetting pad. To wet a tensile strip, the tester holds the top edge of the pad and dips the bottom edge in approximately 0.25 inch (6.35 mm) of tap water located in a wetting pan. After the end of the pad has been saturated with water, the pad is then taken from the wetting pan and the excess water is removed from the pad by lightly tapping the wet edge three times on a wire mesh screen. The wet edge of the pad is then gently placed across the sample, parallel to the width of the sample, in the approximate center of the sample strip. The pad is held in place for approximately one second and then removed and placed back into the wetting pan. The wet sample is then immediately inserted into the tensile grips so the wetted area is approximately centered between the upper and lower grips. The test strip should be centered both horizontally and vertically between the grips. (It should be noted that if any of the wetted portion comes into contact with the grip faces, the specimen must be discarded and the jaws dried off before resuming testing.) The tensile test is then performed and the peak load recorded as the CD wet tensile strength of this specimen. As with the dry tensile tests, the characterization of a product is determined by the average of at least six representative sample measurements.

In addition to measuring the tensile strengths, the "tensile energy absorbed" (TEA) is also reported by the MTS TestWorks® for Windows Ver. 3.10 program for each sample tested. "CD TEA" is reported in the units of grams-centimeters/centimeters squared (g-cm/cm$^2$) and is defined as the integral of the force produced by a specimen with its elongation in the cross-machine direction up to the defined break point (65% drop in peak load) divided by the face area of the specimen.

As used herein, "caliper" is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

As used herein, the "cup crush" test is a test used to determine the stiffness of tissue product by using the peak load and energy units from a constant-rate-of-extension testing machine. The cup crush test is described in U.S. Pat. No. 6,811,638 B2 issued Nov. 2, 2004 to Close et al. and entitled "Method For Controlling Retraction of Composite Materials", herein incorporated by reference. In general, the test involves forming the test sheet into an inverted "cup" within an open-ended metal cylinder, with the open end of the cup-shaped sample facing down, and lowering a hemispherical-shaped probe onto the top of the cup-shaped sample. The peak load and total energy required to "crush" the cup-shaped sample is measured, which simulates the forces applied by a tissue user when a tissue is crumpled within the user's hand. As used herein, the term "peak load" refers to the maximum force applied to the tissue sheet during the test, expressed in grams (force). The term "total energy" is the area under the curve formed by the load (in grams) on one axis and the distance the foot travels (in millimeters) on the other axis as hereinafter described. A lower cup crush value (either peak load or total energy) indicates a more flexible material.

Referring to FIGS. 8-10, the cup crush test will be described in greater detail. Shown schematically in FIG. 8 is a cup-crush testing system 80 with the inverted cup-shaped test sample in place. The testing system includes a cup forming assembly 81 and a force testing unit 82. The force testing unit includes a force sensor 83 to which is cantilevered a test probe comprising a rigid rod 84 and a hemispherical foot 85 positioned at the free end of the rigid rod. Force sensor 83 includes electronics and mechanics for measuring the force of the probe during the test as the probe is lowered in the direction of the arrow. The inverted cup-shaped test sample 86 (which is mostly hidden and shown in phantom lines) is contained within a top hat-shaped former cup 87 and secured between the bottom flange 88 of the former cup and a gripping ring 89 which rests on a base plate 90 during the test. Four corners 91 of the test sample extend outside of the assembly. The hemispherical foot and the forming cup are aligned to avoid contact between the forming cup inner wall and the foot that could affect the readings.

FIG. 9 illustrates the how the sample is formed into an inverted cup shape for testing. Shown are the test sheet 86, the former cup 87, a forming stand 95, and the gripping ring 89 which is sized to slide over the forming stand cylinder. The forming stand cylinder is sized to fit within the former cup with sufficient clearance to not tear the test sheet during sample preparation. The inside diameter of the forming cup is approximately 6.5 centimeters (cm). The test sheet sample is centered and placed on the top of the forming stand (shown in phantom lines) and the top hat-shaped former cup 87 is slowly lowered onto the forming stand 95 until the sample sheet is pinched between the bottom flange 88 of the former cup and the gripping ring 89. There can be gaps between the gripping ring and the forming cup, but at least four corners of the sample sheet must be fixedly pinched there between. The forming cup and ring are then slowly lifted off the forming stand, ensuring that the test specimen keeps the formed shape and remains pinched between the gripping ring and the forming cup. The forming cup containing the sample and the gripping ring are then placed on top of the base plate 90 on the tensile tester with the flange side of the forming cup facing downward toward the base plate. The forming cup and gripping ring will fit snugly into a ridge on the base plate. The sample should be formed alongside the inside of the edges of the forming cup and across the top inside of the open cylinder of the forming cup. The cup-shaped test sample is approximately 6.5 cm in diameter and approximately 6.5 cm tall.

All testing can be done with a Sintech tensile testing frame available from Sintech Corp., 1001 Sheldon Drive, Cary, N.C. 27513 utilizing MTS TestWorks® software from MTS Systems Corporation, Eden Prairie, Minn. Equivalent testers may be used. Sample sheets are conditioned at standard TAPPI conditions of 23°±2° C. and 50%±5% relative humidity for a minimum of four hours prior to testing. The tissue sheet samples are cut to an approximate dimension of 215±30 mm by 235±30 mm. The exact dimensions are not overly critical to the test results, provided the sample is sufficiently large to fill the forming cup. If sample cutting is required, care is to be taken to ensure that the orientation of the plies within the sheet is not changed. An appropriate load cell is selected for the machine such that the peak load values fall between 10% and 90% of the capacity of the load cell. During the test, the load is recorded a minimum of twenty times per second over a 4.5 cm range beginning 0.5 cm below the top of the forming cup while the probe is descending at a rate of about 406.4 mm per minute.

Referring to FIG. 10, in preparing the test apparatus for carrying out the cup crush test, the base plate 90 is positioned on the base of the tensile frame, centered under the load cell. The probe assembly is attached to the load cell using a suitable adapter 95. The gage length (distance between the top of the base plate and the bottom of the hemispherical foot 85 on the probe assembly) is set to 75 mm±1 mm. The crosshead is lowered so the bottom of the hemispherical foot is approximately 25 mm from the top of the base plate. The foot is then released from the adapter 95 by loosening the set screw 96 and allowed to rest on the base plate. The set screw is then tightened and the crosshead zeroed. The crosshead is then raised to 75±1 mm and the load on the crosshead is tared. The crosshead speed is set at 406.4 mm/min. Data is captured at a rate of 20 points per second with total energy calculated between 15 and 60 mm of crosshead travel. The crosshead is allowed to travel to 62 mm to ensure that the last data point, at 60 mm, is captured.

The test is then started with the plunger "crushing" the sample down toward the base plate. After the test is complete and the crosshead has returned to its starting position, the forming cup is removed from the base plate and the sample is removed from the forming cup. Five (5) representative specimens are tested for each product sample with the average of the five specimens reported.

As used herein, the "Stiffness Factor" is the quotient of the cup crush total energy divided by the product of the geometric mean tensile strength and the caliper, times 1000. [(cup crush total energy)/(geometric mean tensile strength) *(caliper)]*1000. The Stiffness Factor is dimensionless.

EXAMPLES

Example 1

Uncreped Throughdried Basesheet

A pilot tissue machine was used to produce a layered, uncreped throughdried tissue basesheet generally as described in FIG. 1. More specifically, the basesheet was made from a stratified fiber furnish containing a center layer of fibers positioned between two outer layers of fibers. The pulp mixture consisted of eucalyptus and northern softwood kraft (LL-19) fibers. Both outer layers of the basesheet contained 100% eucalyptus fibers and the inner layer contained 100% softwood fibers. The two outer layers comprised 48 and 20 weight percent, respectively, of the total weight of the sheet. The inner layer comprised 32 weight percent of the sheet.

The machine-chest furnish containing the fibers was diluted to approximately 0.2 percent consistency and delivered to a layered headbox. The forming fabric speed was approximately 1265 feet per minute (fpm) (386 meters per minute). The basesheet was then rush transferred to a transfer fabric (Voith Fabrics, 2164) traveling 10% slower than the forming fabric using a vacuum roll to assist the transfer. At a second vacuum-assisted transfer, the basesheet was transferred onto the throughdrying fabric (Voith Fabrics, t1203-1). The sheet was dried with a throughdryer resulting in a basesheet having an air-dry basis weight of about 22 grams per square meter (gsm) and rolled into a parent roll for subsequent post treatment and/or converting.

Example 2

Control

Basesheet from Example 1 was converted into a two-ply facial tissue product by unrolling the basesheet from the parent roll, calendering the basesheet with a calender nip pressure of about 15 pounds per square inch in order to generate a target caliper of about 300 microns for the final product, trimming down the basesheet to a width of 21.5 cm, crimping two basesheet plies together, C-folding and cutting the crimped plies in a conventional manner to produce a two-ply facial tissue product.

Example 3A

Invention

The basesheet of Example 1 was fed to a gravure printing line and treated as shown in FIG. 2A where a cross-linking latex flexible polymeric binder material was printed onto one outer surface of the sheet using direct rotogravure printing. The flexible polymeric binder material in this example was a vinyl acetate ethylene copolymer, Airflex® EN1165, which was obtained from Air Products and Chemicals, Inc. of Allentown, Pa. The flexible polymeric binder material formulation contained the following ingredients:

| | |
|---|---|
| 1. Airflex ® EN1165 (52% solids) | 10,500 g |
| 2. Defoamer (Nalco 94PA093) | 50 g |
| 3. Water | 3,400 g |
| 4. Catalyst (10% Citric Acid) | 540 g |
| 5. Thickener (2% Natrosol 250MR, Hercules) | 600 g |

The sheet was printed with a flexible polymeric binder material in a 40 mesh pattern as shown in FIG. 4 with the following specifications:

Cell length: 0.020 inch;

Cell width: 0.0055 inch;

Tip length: 0.0055 inch (each triangle tip height is 0.00275 inch; tip length is two times 0.00275 inch);

Cell depth: 39 micrometers;

Number of elements per inch: 40 (in the machine direction and cross machine direction);

Number of cells per element: 3.

The resulting add-on was approximately from 9 to 11 weight percent based on the dry weight of the fiber in sheet. The printed sheet was then passed over a heated roll to evaporate water.

The printed sheet was then pressed against and creped off a rotating drum, which had a surface temperature of 52° C. Finally the sheet was dried and the flexible polymeric binder material cured using air heated to 260° C. and wound into a roll. Thereafter, the resulting print/creped sheet was converted into two-ply facial tissue product as described in Example 2, without calendering, wherein the two plies were unrolled and crimped together with the printed sides of each ply facing inwardly.

Example 3B

Comparative

A two-ply facial tissue was made as described in Example 3A, except the two plies were crimped together with the printed sides of each ply facing outwardly.

Example 4A

Invention

A two-ply facial tissue product was made as described in Example 3A (with the print/creped sides of the two plies facing inwardly), except the flexible polymeric binder material was Hycar 26684 from Noveon, which is also a crosslinking latex binder. The flexible polymeric binder material formulation contained the following ingredients:

| | |
|---|---|
| 1. Hycar 26684 (49% solids) | 10,500 g |
| 2. Defoamer (Nalco 94PA093) | 50 g |
| 3. Water | 2,000 g |
| 4. Thickener (2% Natrosol 250MR, Hercules) | 1000 g |

Example 4B

Comparative

A two-ply facial tissue was made as described in Example 3B (with the print/creped sides of the two plies facing outwardly), except using the Hycar 26684 binder of Example 4A.

Example 5A

Invention

A two-ply facial tissue was made as described in Example 3A (with the print/creped sides of the two plies facing inwardly), except the flexible polymeric binder material was Airflex 4500 from Air Products, which is not a cross-linking binder. The binder formulation contained the following ingredients:

| | |
|---|---|
| 1. Airflex 4500 (51% solids) | 10,500 g |
| 2. Defoamer (Nalco 94PA093) | 50 g |
| 3. Water | 2,300 g |
| 4. Thickener (2% Natrosol 250MR, Hercules) | 1150 g |

Example 5B

Comparative

A two-ply facial tissue was made as described in Example 3B (with the two print/creped sides of each ply facing outwardly), except using the Airflex 4500 binder of Example 5A.

Table 1 below provides a summary of physical properties of the tissue products made by the Examples.

TABLE 1

| | Control | 3A | 4A | 5A | 3B | 4B | 5B |
|---|---|---|---|---|---|---|---|
| Basis Weight (gsm) | 40.0 | 49.3 | 49.4 | 48.4 | 49.3 | 48.2 | 48.9 |
| Caliper (μm) | 300 | 405 | 395 | 362 | 399 | 394 | 371 |
| Bulk (cm3/g) | 7.50 | 8.22 | 8 | 7.48 | 8.1 | 8.17 | 7.59 |
| GMT (g) | 1198 | 1448 | 1850 | 1636 | 1492 | 1641 | 1628 |
| MD Stretch (%) | 10.0 | 28.1 | 29.8 | 25.2 | 28.5 | 23.6 | 25.8 |
| MD TEA (g-cm/cm$^2$) | 14.4 | 31.6 | 41.3 | 33.9 | 31.9 | 36.4 | 33.1 |
| CD Stretch (%) | 8.8 | 13.2 | 13.9 | 12.0 | 13.2 | 14.0 | 12.0 |
| CD TEA (g-cm/cm$^2$) | 7.0 | 15.2 | 20.3 | 15.8 | 15.3 | 18.5 | 15.4 |
| CD Wet | 391 | 617 | 626 | 418 | 640 | 614 | 411 |
| MD/CD Ratio | 1.66 | 1.35 | 1.42 | 1.41 | 1.44 | 1.33 | 1.47 |
| WET/DRY Ratio | 42% | 50% | 40% | 30% | 51% | 43% | 31% |
| Cup Crush | | | | | | | |
| Pk Load (g) | 86 | 58 | 73 | 68 | 74 | 74 | 71 |
| Ttl Energy (g-mm) | 1738 | 1123 | 1414 | 1317 | 1359 | 1425 | 1360 |

Table 2 set forth the Stiffness Factor values and the values of its components (caliper, geometric mean tensile strength and Cup Crush total energy) for all of the Examples and a variety of commercially available facial tissue products. The data illustrates that the products of this invention exhibit very low Stiffness Factor values.

TABLE 2

| Code | Caliper | GMT | Cup Crush Total Energy | Stiffness Factor |
|---|---|---|---|---|
| Control | 300 | 1198 | 1738 | 4.84 |
| Example 3A | 405 | 1448 | 1123 | 1.91 |
| Example 4A | 395 | 1850 | 1414 | 1.93 |
| Example 5A | 362 | 1636 | 1317 | 2.22 |
| Example 3B | 399 | 1492 | 1359 | 2.28 |
| Example 4B | 394 | 1641 | 1425 | 2.20 |
| Example 5B | 371 | 1628 | 1360 | 2.25 |
| Puffs ® ES | 306 | 1041 | 1245 | 3.91 |
| Puffs ® | 292 | 704 | 704 | 3.42 |
| Kleenex ® Ultrasoft | 259 | 804 | 882 | 4.24 |
| Puffs ® Plus | 356 | 1012 | 1313 | 3.64 |
| Scotties ® 3-ply | 276 | 805 | 931 | 4.19 |
| Kleenex ® | 181 | 611 | 614 | 5.55 |
| Scotties ® 3-ply w/lotion | 257 | 748 | 807 | 4.20 |
| Scotties ® 2-ply | 229 | 669 | 797 | 5.20 |
| Albertsons WS w/lotion | 256 | 805 | 1107 | 5.37 |
| Albertsons WS | 210 | 832 | 903 | 5.17 |
| Kleenex ® w/lotion | 311 | 876 | 1192 | 4.38 |

In order to further illustrate the improved properties of the products of this invention, facial tissues of the Examples were submitted to trained sensory panels in order to further evaluate softness and stiffness. The results are shown in FIG. 6. As shown, the facial tissue products in which the two plies were oriented such that the flexible polymeric binder material was on the inwardly facing side of each ply (Examples 3A, 4A and 5A) exhibited improved softness relative to the control tissue product. On the other hand, when the products were converted such that the flexible polymeric binder material was on the outwardly facing side of each ply (Examples 3B, 4B and 5B), the overall softness was significantly decreased with respect to the Control.

FIG. 7 further illustrates the advantage of plying the flexible polymeric binder material-treated plies together with the flexible polymeric binder material-treated side being placed on the inwardly-facing side of each ply when softness and strength are both taken into account. Specifically, shown is a plot of the Panel Softness value versus the geometric mean tensile strength for all of the Examples.

It will be appreciated that the foregoing examples, given for purposes of illustration, are not to be construed as limiting the scope of this invention, which is defined by the following claims and all equivalents thereto.

We claim:

1. A multi-ply tissue product comprising two outer plies, each of the two outer plies having an inwardly-facing surface and an outwardly-facing surface, wherein the inwardly-facing surface of each outer ply has a print/creped application of a flexible polymeric binder material, said tissue product having a Stiffness Factor of about 3.0 or less.

2. The tissue product of claim 1 having a Stiffness Factor of about 2.0 or less.

3. The tissue product of claim 1 having a Stiffness Factor of from about 1.5 to about 2.5.

4. The tissue product of claim 1 having a Stiffness Factor of from about 1.8 to about 2.2.

5. The tissue product of claim 1 having a basis weight of from about 15 to about 55 grams per square meter.

6. The tissue product of claim 1 having a geometric mean tensile strength of from about 700 to about 2500 grams (force) per 3 inches of sample width.

7. The tissue product of claim 1 having a caliper of from about 250 to about 500 microns.

8. The tissue product of claim 1 having a bulk of from about 6 to about 12 cubic centimeters per gram.

9. The tissue product of claim 1 consisting of two plies.

10. The tissue product of claim 1 comprising one or more inner plies.

11. The tissue product of claim 1 wherein the flexible polymeric binder material has a glass transition temperature of about 50° C. or less.

12. The tissue product of claim 1 wherein the flexible polymeric binder material is an ethylene/vinylacetate copolymer.

13. The tissue product of claim 1 wherein the amount of the flexible polymeric binder material in each of the two outer plies is from about 1 to about 12 percent by weight of dry fiber in each ply.

14. The tissue product of claim 1 wherein the surface area coverage of the printed application of the flexible polymeric binder material is from about 20 to about 90 percent.

15. A method of making a multi-ply tissue product comprising:

(a) providing a throughdried basesheet;

(b) printing a flexible polymeric binder material onto one surface of the basesheet;

(c) adhering the resulting printed surface of the basesheet to a creping cylinder and creping the basesheet, whereby the resulting basesheet has a print/creped surface and a non-print/creped surface; and (d) converting the resulting basesheet into a multi-ply tissue product having two outer plies such that the print/creped surface of each outer ply is facing inwardly and the tissue product has a Stiffness Factor of about 3.0 or less.

16. The method of claim 15 wherein the flexible polymeric binder material is an ethylene/vinylacetate copolymer.

17. The method of claim 15 wherein the amount of the flexible polymeric binder material printed onto each of the two outer plies is from about 1 to about 12 percent by weight of dry fiber in each ply.

18. The method of claim 15 wherein the surface area coverage of the printed application of the flexible polymeric binder material is from about 20 to about 90 percent.

* * * * *